US007031483B2

(12) United States Patent
Boone et al.

(10) Patent No.: US 7,031,483 B2
(45) Date of Patent: Apr. 18, 2006

(54) HEARING AID COMPRISING AN ARRAY OF MICROPHONES

(75) Inventors: Marinus Marias Boone, Zoetermeer (NL); Augustinus Johannes Berkhout, The Hague (NL); Ivo Léon Diane Marie Merks, Eindhoven (NL)

(73) Assignees: Technische Universiteit Delft, Delft (NL); Stichting voor de Technische Wetenschappen, Utrecht (NL)

( * ) Notice: Subject to any disclaimer, the term of this patent is extended or adjusted under 35 U.S.C. 154(b) by 0 days.

(21) Appl. No.: 09/529,778

(22) PCT Filed: Oct. 20, 1998

(86) PCT No.: PCT/NL98/00602

§ 371 (c)(1),
(2), (4) Date: Jul. 17, 2000

(87) PCT Pub. No.: WO99/21400

PCT Pub. Date: Apr. 29, 1999

(65) Prior Publication Data

US 2003/0156725 A1 Aug. 21, 2003

(30) Foreign Application Priority Data

Oct. 20, 1997 (NL) ..... 1007321

(51) Int. Cl.
*H05R 25/00* (2006.01)

(52) U.S. Cl. ..... 381/313; 381/312; 381/356

(58) Field of Classification Search ..... 381/23.1, 381/60, 312–313, 327, 92, 356, 91, 122, 381/316–318, 320, 357–358
See application file for complete search history.

(56) References Cited

U.S. PATENT DOCUMENTS

| | | | | |
|---|---|---|---|---|
| 3,770,911 A | | 11/1973 | Knowles et al. | |
| 3,789,163 A | * | 1/1974 | Dunlavy | 381/327 |
| 3,946,168 A | | 3/1976 | Preves | |
| 4,712,244 A | * | 12/1987 | Zwicker et al. | 381/327 |
| 4,773,095 A | * | 9/1988 | Zwicker et al. | 381/327 |
| 4,904,078 A | | 2/1990 | Gorike | |

(Continued)

FOREIGN PATENT DOCUMENTS

DE 2 236 968 1/1974

OTHER PUBLICATIONS

W. Soede et al., "Development of a directional hearing instrument based on array technology," 8014 The Journal of the Acoustical Society of America, 94 Aug. 1993, No. 2, Part 1, pp. 785-798 no day.

*Primary Examiner*—Suhan Ni
(74) *Attorney, Agent, or Firm*—Young & Thompson

(57) ABSTRACT

Hearing aid for improving the hearing ability of the hard of hearing, comprising an array of microphones, the electrical output signals of which are fed to at least one transmission path belonging to an ear. Means are provided for deriving two array output signals from the output signals of the microphones, the array having two main sensitivity directions running at an angle with respect to one another and each of which is associated to an array output signal. Each array output signal is fed to its own transmission path belonging to one ear of a person who is hard of hearing.

59 Claims, 3 Drawing Sheets

U.S. PATENT DOCUMENTS 5,201,006 A 4/1993 Weinrich
5,214,709 A 5/1993 Ribic
5,483,599 A 1/1996 Zagorski
5,511,128 A 4/1996 Lindemann
5,737,430 A * 4/1998 Widrow ..... 381/313
5,757,933 A 5/1998 Preves et al.
5,764,778 A * 6/1998 Zurek ..... 381/313
5,793,875 A * 8/1998 Lehr et al. ..... 381/313

* cited by examiner

HEARING AID COMPRISING AN ARRAY OF MICROPHONES

BACKGROUND OF THE INVENTION

1. Field of the Invention

The invention relates to a hearing aid for improving the hearing ability of the hard of hearing, comprising an array of microphones, the electrical output signals of which are fed to at least one transmission path belonging to an ear.

2. Description of the Related Art

A device of this type is known from the article entitled "Development of a directional hearing instrument based on array technology" published in the "Journal of the Acoustical Society of America", Vol. 94, Edition 2, Pt. 1, pages 785–798, August 1993.

It is generally known that loss of hearing in people can be compensated for by means of a hearing aid, in which amplification of the received sound is used. In environments with background noise, for example when several people are speaking at once, as is the case at a cocktail party, the hearing aid amplifies both the desired speech and the noise, as a result of which the ability to hear is not improved.

In the abovementioned article the authors describe an improvement proposal. The hearing aid disclosed in the article consists of an array of, for example, five directional microphones, as a result of which it is possible for the person who is hard of hearing to understand someone who is speaking directly opposite him or her. The background noise which emanates from other directions is suppressed by the array.

From U.S. Pat. No. 4,956,867 an apparatus for suppressing signals from noise sources surrounding a target source is known. This apparatus comprises a receiving array including two microphones spaced apart by a distance. The outputs of the microphones are combined such that a primary signal channel and a noise signal channel are obtained. The outputs of the channels are substrated for cancelling the noise from the primary signal channel.

SUMMARY OF THE INVENTION

The aim of the invention is to provide a hearing aid of the type mentioned in the preamble with which the abovementioned disadvantages are avoided and the understandability of the naturalness of the reproduction improved in a simple manner.

Said aim is achieved according to the invention in that means are provided for deriving two array output signals from the output signals of the microphones, the array having two main sensitivity directions running at an angle with respect to the main axis of the array, and each of which is associated to an array output signal, and in that each array output signal is fed to its own transmission path one to the left ear and the other to the right ear of a person who is hard of hearing.

With this arrangement the signals from the microphones of the array are combined to give a signal for the left ear and a signal for the right ear. The array has two main sensitivity directions or main lobes running at an angle with respect to one another, the left ear signal essentially representing the sound originating from the first main sensitivity direction and the right ear signal representing that from the other main sensitivity direction. The array output signals, that is to say the left ear signal and the right ear signal, are fed via their own transmission path to the left ear and the right ear, respectively. Amplification of the signal and conversion of the electrical signal into a sound signal is employed in said transmission path.

The different main lobes introduce a difference in level between the signals to be fed to the ears. It has been found that it is not only possible to localize sound sources better, but that background noise is also suppressed as a result of the directional effect, as a result of which the understandability of speech is improved despite the existing noise.

The array can advantageously be mounted on the front of a spectacle frame and/or on the arms or springs.

In the case of an embodiment which is preferably to be used, each spectacle arm is also provided with an array of microphones, the output signals from the one array being fed to the one transmission path and the output signals from the other array being fed to the other transmission path.

What is achieved by this means is that understandability is improved not only at high frequencies in the audible sound range but also at relatively low frequencies.

Further embodiments of the invention are described in the subsidiary claims.

BRIEF DESCRIPTION OF THE DRAWINGS

The invention will be explained in more detail below with reference to the drawings. In the drawings.

DESCRIPTION OF THE PREFERRED EMBODIMENTS

The hearing aid according to the invention comprises an array of microphones. Said array can have any shape.

Said array has two array output signals which are each fed along their own transmission path, one to the left ear and the other to the right ear of the person hard of hearing. In said transmission path amplification and conversion of the electrical signal from the array to sound vibrations are employed in the conventional manner.

The array has two main sensitivity directions running at an angle with respect to one another, the various features being such that the first array output signal is essentially a reflection of the sound from the first main sensitivity direction, whilst the second array output signal essentially represents the sound from the second main sensitivity direction. As a result the left ear as it were listens in a restricted first main sensitivity direction, whilst the right ear listens in the second main sensitivity direction.

The main sensitivity directions associated with the array output signals can be achieved by focusing or bundling the microphone signals.

Figure 1:
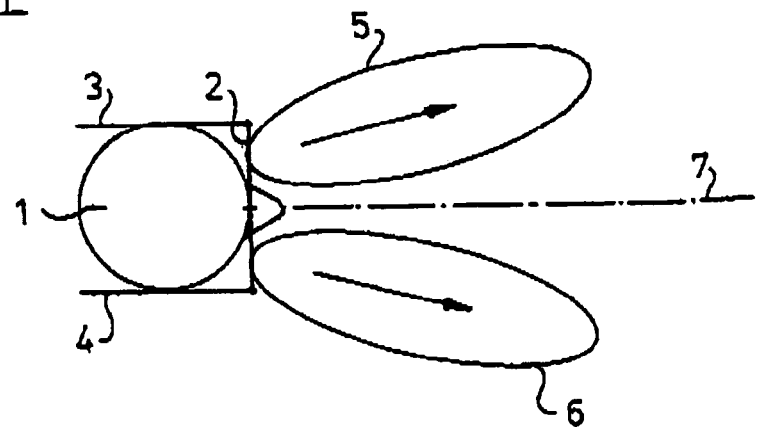
FIG. 1 shows an embodiment of the hearing aid according to the invention.

The array of microphones can be attached in a simple manner to spectacle frames. FIG. 1 shows an embodiment of an array of microphones on the front of the spectacle frames, bundling being employed.

In FIG. 1 the head of a person hard of hearing is indicated diagrammatically by reference number 1. The spectacles worn by this person as shown diagrammatically by straight lines, which spectacles consist, in the conventional manner, of a front 2 and two spectacle arms or springs 3, 4.

The main lobe 5 for the left ear and the main lobe 6 for the right ear are also shown in FIG. 1 as ellipses. Said main lobes are at an angle with respect to one another and with respect to the main axis 7 of the spectacles.

As a result of the main lobes used above and the separate assignment thereof to the ears, a difference between the level of the array output signals is artificially introduced depending on the location of the sound source and also for the noise. As a result of said artificial difference in the levels of the array output signals, the person hard of hearing is able to localize the sound source, but is has been found that said difference also improves the understandability of speech in the presence of noise.

Positioning the array of microphones on one or both of the spectacle arms is also advantageous.

The association of the array output signals to the associated main lobes of the array can be achieved in a simple manner by means of a so-called parallel or serial construction.

In the case of the parallel construction, the means for deriving the array output signals comprise a summing device, the microphone output signals being fed to the inputs of said summing device via a respective frequency-dependent or frequency-independent weighting factor device. An array output signal can then be taken off at the output of the summing device. A main sensitivity direction associated with the relevant array output signal can be obtained by sizing the weighting factor devices.

In the case of the so-called serial construction, the means for deriving the array output signals contain a number of summing devices and weighting factor devices, the weighting factor devices in each case being connected in series with the input and output of the summing devices. With this arrangement one outermost microphone is connected to an input of a weighting factor device, the output of which is then connected to an input of a summing device. The output of the microphone adjacent to the said outermost microphone is connected to the input of the summing device. The output of the summing device is connected to the input of the next weighting factor device, the output of which is connected to the input of the next summing device. The output of the next microphone is, in turn, connected to the other input of this summing device.

This configuration is continued as far as the other outermost microphone of the array. An array output signal, for example the left ear signal, can be taken off from the output of the last summing device, the input of which is connected to the output of the last-mentioned outermost microphone. It could also be possible to derive the array output signal from the output of the said last summing device via a further weighting factor device.

In a further development, the weighting factor device comprises a delay device, optionally supplemented by an amplitude-adjustment device.

In another development, the weighting factor device consists of a phase adjustment device, optionally supplemented by an amplitude-adjustment device.

Figure 2:
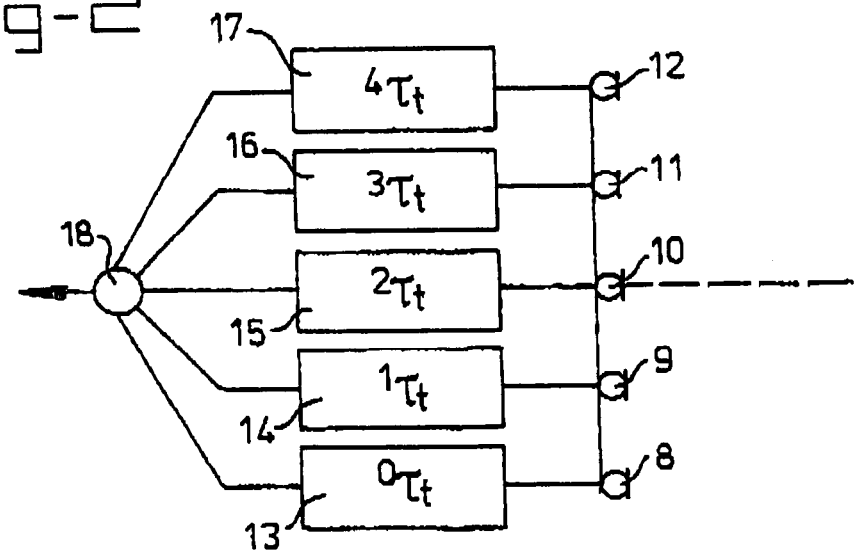
FIG. 2 shows a more detailed embodiment of the hearing aid according to the invention.

FIG. 2 shows the parallel construction with delay devices. The microphones 8, 9, 10, 11 and 12 are shown on the right of FIG. 2, which microphones are connected by a line in the drawing to indicate that it is an array that is concerned here. The outputs of the microphones 8–12 are connected to the inputs of the respective delay devices 13, 14, 15, 16 and 17. The outputs of the said delay devices 13–17 are connected to the inputs of the summing device 18, at the output of which an array output signal, for example a left ear signal, can be derived. An amplitude-adjustment device, which can consist of an amplifier or an attenuator, can be incorporated, in a manner which is not shown, in each path between a microphone and an input of the summing device. Preferably, the signal of the $n^{th}$ microphone is delayed by a period $n\tau_t$. FIG. 2 shows that the output signal from the microphone 8 is fed to the input of the summing device 18 with a delay period O, whilst the output signal from the microphone 9 is fed to the next input of the summing device 18 with a delay $\tau_t$. The corresponding delays apply in the case of the microphones 10, 11 and 12; that is to say delay periods of $2\tau_t$, $3\tau_t$ and $4\tau_t$ respectively. The delay period $\tau_t$ is chosen such that sound emanating from the direction which makes an angle of θ with respect to the main axis of the array is summed in phase. Then: $\tau_t = d\sin\theta/c$, where d is the distance between two microphones and c is the wave propagation rate.

A similar arrangement can be designed for the right ear signal.

Figure 3:
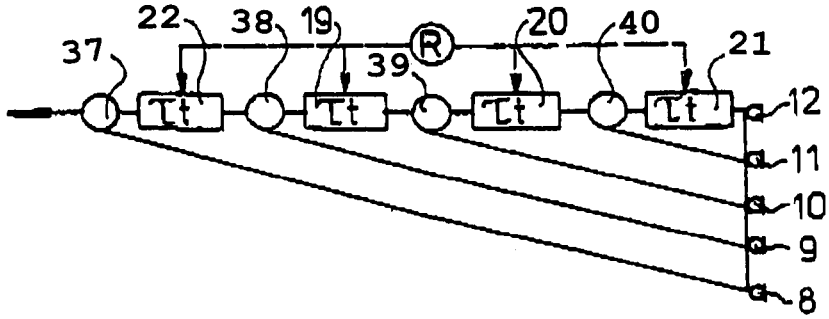
FIG. 3 shows another embodiment of the hearing aid according to the invention.

FIG. 3 shows the so-called serial construction with delay devices.

In the case of this embodiment shown a series circuit of 4 delay devices 19–22 and 4 summing devices 37–40 is used. The delay devices and summing devices are connected alternately in series. The microphone 12 is connected to the input of the delay device 21, whilst the outputs of the microphones 8–11 are connected to the respective summing devices 37–40.

With this embodiment as well the signal from the microphone 12 is delayed by a delay period of 4 times $\tau_t$, if each delay device produces a delay of $\tau_t$. After adding in the summing device 40, the output signal from the microphone 11 is delayed by a delay period of 3 times $\tau_t$. Corresponding delays apply in respect of the microphones 9 and 10. The output signal from the microphone 8 is not delayed. If desired, a further delay device can be incorporated behind the summing device 37.

With this so-called serial construction as well it is possible to incorporate amplitude-adjustment devices in the form of amplifiers or attenuators in each part of the series circuit, each amplitude-adjustment device being associated with an output signal from a specific microphone in the array. The delay device used can simply be an all-pass filter of the first order, which can be adjusted by means of a potentiometer.

A microphone array 14 cm long can be used as a practical embodiment. As a consequence of the means described above for deriving the output signals from the microphones which are each associated with one main sensitivity direction, the microphones used can be very simple microphones of omnidirectional sensitivity. If desired, cardioid microphones can be used to obtain additional directional sensitivity.

If the angle between the two main sensitivity directions or main lobes becomes greater, the difference between the audible signals, i.e. the inter-ear level difference, will become greater. Consequently the localizability will in general become better.

However, as the said angle between the main lobes becomes greater, the attenuation of a sound signal will increase in the direction of a main axis of the array. The choice of the angle between the main lobes will thus, in practice, be a compromise between a good inter-ear level difference and an acceptable attenuation in the main direction of the array. This choice will preferably be determined experimentally.

Furthermore, on enlarging the angle between the main lobes, the main lobes will each be split into two lobes beyond a certain angle. This phenomenon can be avoided by use of an amplitude-weighting function for the microphone signals.

Figure 4:
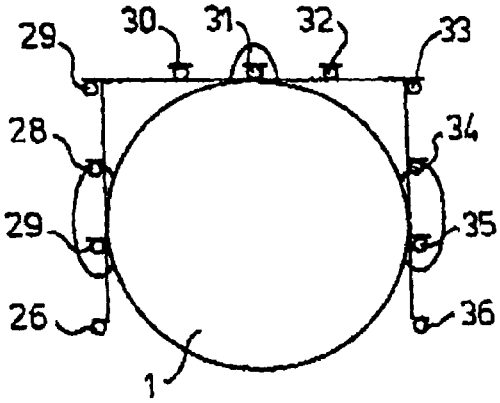
FIG. 4 shows an embodiment of the hearing aid according to FIG. 4 in which a combination of arrays is used, which embodiment is preferably to be used.

In the case of an embodiment of the invention that is preferably to be used, an array attached to the front of the spectacle frames and two arrays, each attached to one arm of the spectacles, are used. An example with eleven microphones is shown in FIG. 4. The microphones 26, 27 and 28, which form the left array, are attached to the left arm of the spectacles and the microphones 34, 35 and 36 of the right array are attached to the right arm of the spectacles. The microphones 29–33 are attached to the front of the spectacle frames.

The signals from the microphones 29–33 are fed in the manner described above to the transmission paths for the left and the right ear, respectively. The signals from the microphones 26, 27 and 28 are coupled to the transmission path for the left ear, whilst the signals from the microphones 34–36 are fed via the other transmission path to the right ear.

At high frequencies an inter-ear level difference is created with the aid of bundling the array at the front of the spectacle frames and the shadow effect of the arrays on the arms of the spectacles has an influence. At low frequencies an inter-ear time difference is created by means of the arrays on the arms of the spectacles. An inter-ear time difference is defined as the difference in arrival time between the signals at the ears as a consequence of the difference in propagation time.

Figure 5:
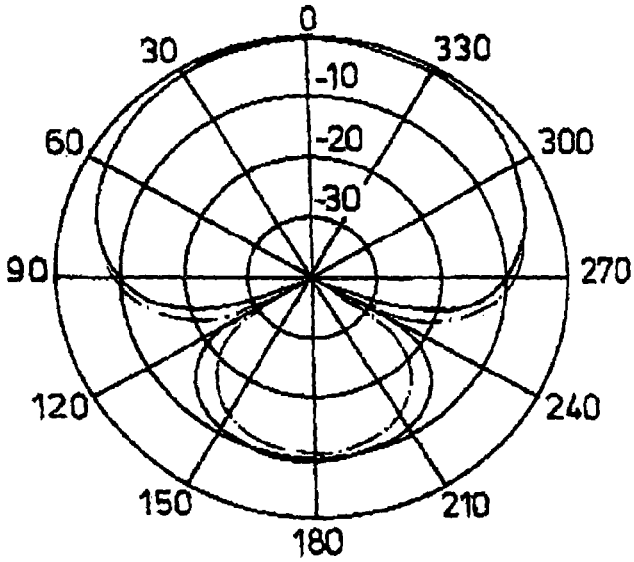
FIG. 5 shows a polar diagram of a combined array from FIG. 1 at 500 and 1000 Hz.

FIG. 5 shows the directional characteristics of the combination of arrays in FIG. 4 at a frequency of 500 Hz, indicated by a dash-and-dot line, and at 1000 Hz, indicated by a continuous line. The directional characteristics in FIG. 5 are obtained with the arrays on the arms of the spectacles. The array on the front of the spectacles is thus switched off since it yields little additional directional effect at low frequencies. In this way an inter-ear time difference is thus created.

Figure 6:
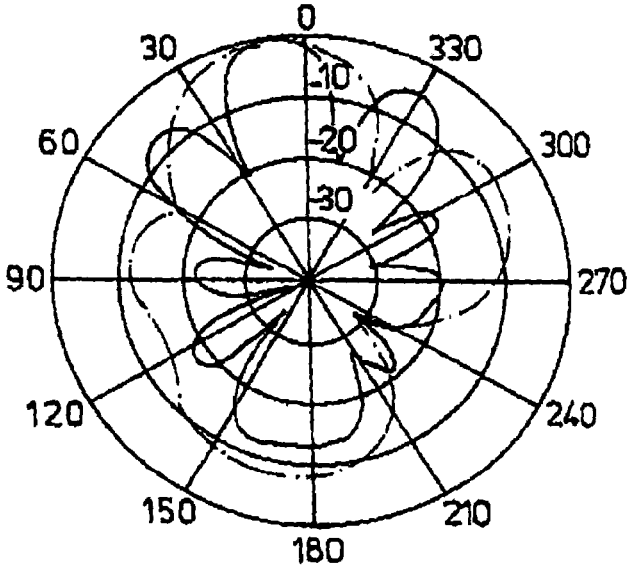
FIG. 6 shows a polar diagram of an embodiment from FIG. 1 at 2000 and 4000 Hz.

FIG. 6 shows the directional characteristics of the combination of arrays at 2000 Hz, indicated by a dash-and-dot line, 2 and at 4000 Hz, indicated by a continuous line. In the mid and high frequency region of the audible sound range the main lobes are directed at 11°, so that once again an inter-ear level difference is created.

Figure 7:
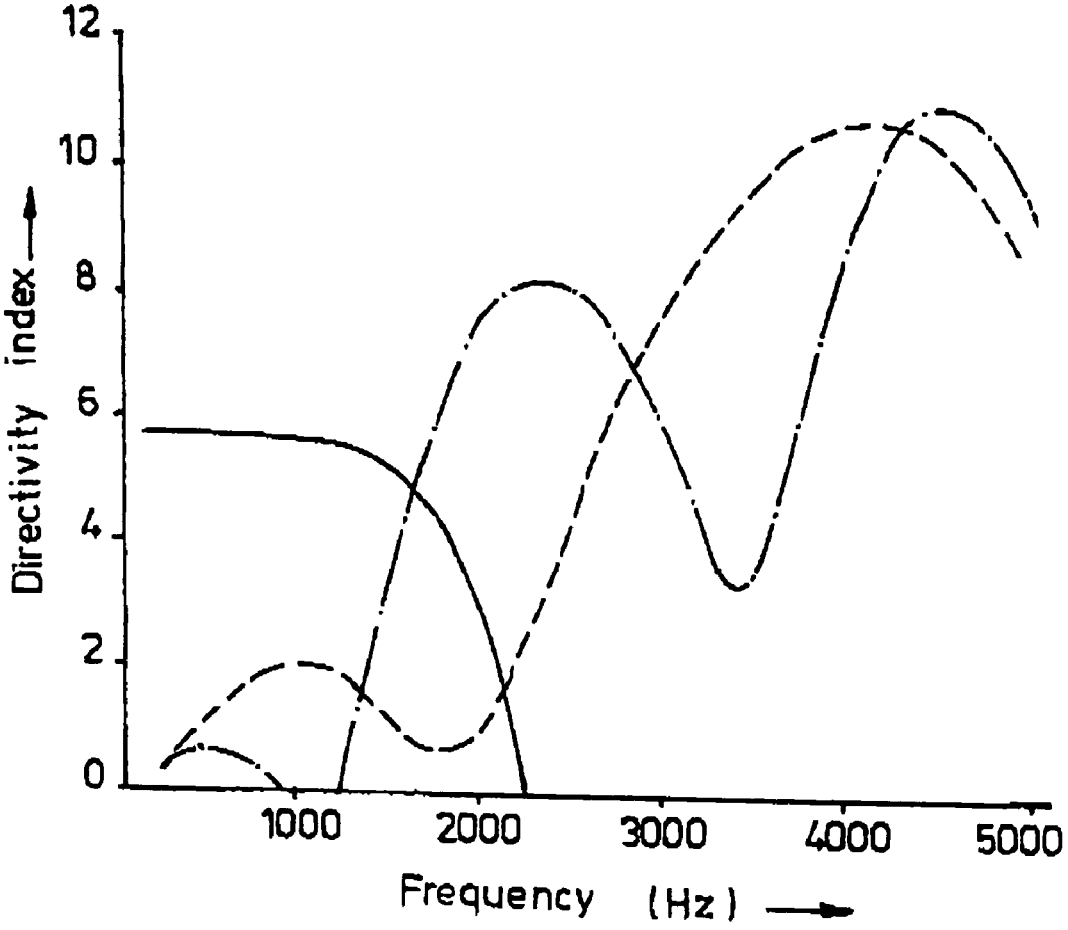
FIG. 7 shows the directional index of the embodiment in FIG. 4 as a function of the frequency.

FIG. 7 shows the directivity index as a function of the frequency for 3 optimized frequency ranges. The continuous line applies for the low frequencies, optimized at 500 Hz. The broken line applies for optimization at 4000 Hz and the dash-and-dot line for optimization at 2300 Hz.

It is also pointed out that an inter-ear level difference can also be produced with the arrays on the arms of the spectacles as with the array on the front of the spectacle frames.

What is claimed is:

1. A hearing aid for improving the hearing ability of a user, comprising:

an array of microphones, each producing a respective microphone output signal;

each left and right summing structures, each receiving as inputs a subset of the microphone output signals, being constructed so as to generate left and right array output signals, respectively; and left and right transmissions paths, each carrying a corresponding one of the left and right array output signals to a corresponding ear of the user;

wherein each of the left and right summing structures acts on a corresponding said subset of microphone output signals so that the different left and right array output signals correspond respectively to two distinct main sensitivity directions that are associated with two distinct main sensitivity lobes and lie at an angle to one another, which angle deviates from 0°.

2. The hearing aid according to claim 1, wherein at least part of the array is mounted on at least one of a front and one or two temples of a pair of spectacles.

3. The hearing aid according to claim 2, each of said two distinct main sensitivity directions being at an angle, which deviates from 0°, to said temples.

4. The hearing aid according to claim 3, wherein each said temple of the pair of spectacles is provided with those of the array of microphones that produce a respective one of the subsets of the microphone output signals.

5. The hearing aid according to claim 1, wherein each of the left and right summing structures comprises a summing device, the summing device receiving as inputs weighted versions of the microphone output signals produced by corresponding weighting factor devices.

6. The hearing aid according to claim 5, wherein the weighting factor device comprises a delay device.

7. The hearing aid according to claim 6, wherein the weighting factor device comprises an amplitude-adjustment device.

8. The hearing aid according to claim 5, wherein the weighting factor device comprises a phase-adjustment device.

9. The hearing aid according to claim 8, wherein the weighting factor device further comprises an amplitude-adjustment device.

10. The hearing aid according to claim 1, wherein each of the left and right summing structures comprises a series circuit of weighting factor device and summing device pairs;

wherein in each said pair, the summing device receives, as a first input, an output of the corresponding weighting factor device, and the summing device receives, as a second input, a respective one of the microphone output signals;

in each but a first of the pairs an input of the weighting factor device is provided by an output of a preceding one of the summing devices in the series circuit, and in the first of the pairs the input of the weighting factor device is provided by the microphone output signal of an outermost one of the microphones; and an output of the summing device of a last of the series circuit pairs provides a respective one of the left and right array output signals.

11. The hearing aid according to claim 10, wherein the array output signal is derived via a further weighting factor device.

12. The hearing aid according to claim 11, wherein the weighting factor device comprises a delay device.

13. The hearing aid according to claim 11, wherein the weighting factor device comprises a phase-adjustment device.

14. The hearing aid according to claim 10, wherein the weighting factor device comprises a delay device.

15. The hearing aid according to claim 10, wherein the weighting factor device comprises a phase-adjustment device.

16. The hearing aid of claim 1, wherein each of the left and right summing structures operates in a frequency-independent manner so that each of the main sensitivity directions is frequency-independent.

17. The hearing aid of claim 16, wherein each of the microphones is omnidirectional.

18. The hearing aid according to claim 17, wherein at least part of the array is mounted on a temple of a pair of spectacles and said two main distinct sensitivity directions being at an angle, which deviates from 0°, to said temple.

19. The hearing aid according to claim 18, wherein said spectacles have two temples and each of said temples is provided with those of the array of microphones that produce a respective one of the subsets of the microphone output signals.

20. The hearing aid of claim 1, wherein each of the main sensitivity directions also lies at an angle to a main axis of the array.

21. The hearing aid of claim 1, wherein at least one of the microphones is omnidirectional.

22. The hearing aid of claim 1, wherein each of the microphones is omnidirectional.

23. A hearing aid for improving the hearing ability of a user, comprising:

an array of microphones, each producing a respective microphone output signal;

means for converting a first subset of the microphone output signals to a left array output signal;

means for converting a second subset of the microphone output signals to a right array output signal;

left and right transmissions paths, each carrying a corresponding one of the left and right array output signals to a corresponding ear of the user;

wherein each means for converting acts on a corresponding said subset of microphone output signals so that the different left and right array output signals correspond respectively to two distinct main sensitivity directions that are associated with two distinct main sensitivity lobes and lie at an angle to one another, which angle deviates from 0°.

24. The hearing aid of claim 23, wherein at least one of the microphones is omnidirectional.

25. The hearing aid of claim 23, wherein each of the microphones is omnidirectional.

26. The hearing aid of claim 23, wherein each of the main sensitivity directions also lies at an angle to a main axis of the array.

27. The hearing aid of claim 23, wherein each means for converting operates in a frequency-independent manner so that each of the main sensitivity directions is frequency-independent.

28. The hearing aid of claim 27, wherein each of the microphones is omnidirectional.

29. The hearing aid according to claim 28, wherein at least part of the array is mounted on a temple of a pair of spectacles and said two main distinct sensitivity directions being at an angle, which deviates from 0°, to said temple.

30. The hearing aid according to claim 29, wherein said spectacles have two temples and each of said temples is provided with those of the array of microphones that produce a respective one of the subsets of the microphone output signals.

31. The hearing aid according to claim 23, wherein at least part of the array is mounted on a front of a pair of spectacles.

32. The hearing aid according to claim 23, wherein at least part of the array is mounted on a temple of a pair of spectacles and said two main distinct sensitivity directions being at an angle, which deviates from 0°, to said temple.

33. The hearing aid according to claim 32, wherein said spectacles have two temples and each of said temples is provided with those of the array of microphones that produce a respective one of the subsets of the microphone output signals.

34. A hearing aid for improving the hearing ability of a user, comprising:

an array of microphones, each producing a respective microphone output signal;

left and right summing structures, each receiving as inputs a subset of the microphone output signals, each being constructed so as to generate left and right array output signals, respectively;

left and right transmissions paths, each carrying a corresponding one of the left and right array output signals to a corresponding ear of the user;

wherein each of the left and right summing structures acts on its subset of microphone output signals so that the different left and right array output signals correspond respectively to two distinct main sensitivity directions that are associated with two distinct main sensitivity lobes and lie at an angle to one another, which angle deviates from 0°; and wherein each of the left and right summing structures operates so that the array output signals include low, mid, and high audio frequency components.

35. The hearing aid of claim 34, wherein at least one of the microphones is omnidirectional.

36. The hearing aid of claim 34, wherein each of the microphones is omnidirectional.

37. The hearing aid of claim 34, wherein each of the main sensitivity directions also lies at an angle to a main axis of the array.

38. The hearing aid of 34, wherein the mid-frequency components include signals having a frequency of 2000 Hz.

39. The hearing aid of 38, wherein the high-frequency components include signals having a frequency of 4000 Hz.

40. The hearing aid of 39, wherein the low-frequency components include signals having a frequency of 500 Hz.

41. The hearing aid of claim 40, wherein each of the microphones is omnidirectional.

42. The hearing aid according to claim 41, wherein at least part of the array is mounted on a temple of a pair of spectacles and said two main distinct sensitivity directions being at an angle, which deviates from 0°, to said temple.

43. The hearing aid according to claim 42, wherein said spectacles have two temples and each of said temples is provided with those of the array of microphones that produce a respective one of the subsets of the microphone output signals.

44. The hearing aid according to claim 34, wherein at least part of the array is mounted on a front of a pair of spectacles.

45. The hearing aid according to claim 34, wherein at least part of the array is mounted on a temple of a pair of spectacles and said two main distinct sensitivity directions being at an angle, which deviates from 0°, to said temple.

46. The hearing aid according to claim 45, wherein said spectacles have two temples and each of said temples is provided with those of the array of microphones that produce a respective one of the subsets of the microphone output signals.

47. A hearing aid for improving the hearing ability of a user, comprising:

an array of microphones, each producing a respective microphone output signal;

means for converting a first subset of the microphone output signals to a left array output signal that corresponds to a first main sensitivity direction that is associated with a first main sensitivity lobe;

means for converting a second subset of the microphone output signals to a right array output signal that corresponds to a second main sensitivity direction that is associated with a second main sensitivity lobe and lies at an angle to the first main sensitivity direction, which angle deviates from 0°; and left and right transmissions paths, each carrying a corresponding one of the different left and right array output signals to a corresponding ear of the user;

wherein each means for converting operates so that the array output signals include low, mid, and high audio frequency components.

48. The hearing aid of claim 47, wherein at least one of the microphones is omnidirectional.

49. The hearing aid of claim 47, wherein each of the microphones is omnidirectional.

50. The hearing aid of claim 47, wherein each of the main sensitivity directions also lie at an angle to a main axis of the array.

51. The hearing aid of 47, wherein the mid-frequency components include signals having a frequency of 2000 Hz.

52. The hearing aid of 51, wherein the high-frequency components include signals having a frequency of 4000 Hz.

53. The hearing aid of 51, wherein the low-frequency components include signals having a frequency of 500 Hz.

54. The hearing aid of claim 53, wherein each of the microphones is omnidirectional.

55. The hearing aid according to claim 54, wherein at least part of the array is mounted on a temple of a pair of spectacles and said two main distinct sensitivity directions being at an angle, which deviates from 0°, to said temple.

56. The hearing aid according to claim 55, wherein said spectacles have two temples and each of said temples is provided with those of the array of microphones that produce a respective one of the subsets of the microphone output signals.

57. The hearing aid according to claim 47, wherein at least part of the array is mounted on a front of a pair of spectacles.

58. The hearing aid according to claim 47, wherein at least part of the array is mounted on a temple of a pair of spectacles and said two main distinct sensitivity directions being at an angle, which deviates from 0°, to said temple.

59. The hearing aid according to claim 58, wherein said spectacles have two temples and each of said temples is provided with those of the array of microphones that produce a respective one of the subsets of the microphone output signals.

* * * * *